US007749000B1

(12) United States Patent
Lai

(10) Patent No.: US 7,749,000 B1
(45) Date of Patent: Jul. 6, 2010

(54) ELECTRICAL CONNECTOR

(75) Inventor: Ming-Chun Lai, Tu-Cheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/423,014

(22) Filed: Apr. 14, 2009

(51) Int. Cl.
*H01R 12/00* (2006.01)

(52) U.S. Cl. ..... 439/83; 439/95; 439/108; 439/497

(58) Field of Classification Search ..... 439/83, 439/95, 108, 181, 497, 607.02, 607.46, 931
See application file for complete search history.

(56) References Cited

U.S. PATENT DOCUMENTS 5,028,492 A * 7/1991 Guenin ..... 428/614
5,509,823 A * 4/1996 Harting et al. ..... 439/607.17
5,961,347 A * 10/1999 Hsu ..... 439/570
6,053,744 A * 4/2000 Gray et al. ..... 439/63
6,383,025 B1 * 5/2002 Shi et al. ..... 439/607.38
6,488,533 B1 * 12/2002 Thompson et al. ..... 439/509
6,793,508 B2 * 9/2004 Chang ..... 439/95
7,329,150 B2 * 2/2008 Ju ..... 439/607.11
7,364,458 B1 * 4/2008 Ju ..... 439/524
7,374,432 B2 * 5/2008 Koguchi et al. ..... 439/74
2006/0121782 A1 * 6/2006 Shen et al. ..... 439/607
2007/0238329 A1 * 10/2007 Ju ..... 439/95

* cited by examiner

*Primary Examiner*—James Harvey

(57) ABSTRACT

An electrical connector adapted to be mounted to a PCB for electrically connecting with a butting component includes an insulating housing and a plurality of terminals received in the insulating housing. The insulating housing defines a soldering surface and a mating surface contiguous to the soldering surface. The mating surface has a receiving recess for receiving the butting component. The receiving recess has a bottom protruding outwards to form a receiving plate substantially perpendicular to the soldering surface, with a plurality of terminal grooves extending substantially perpendicular to the mating surface formed thereon. Each of the terminals has a contacting portion received in the terminal groove and a soldering portion substantially perpendicular to the contacting portion. The soldering portions are arranged in plural rows and extend outside the soldering surface for being soldered on the PCB.

9 Claims, 5 Drawing Sheets

ELECTRICAL CONNECTOR

BACKGROUND OF THE INVENTION

1. Field of the Invention

The present invention relates to an electrical connector, and more particularly to an electrical connector mounted on a printed circuit board with a small occupied space.

2. The Related Art

A conventional electrical connector mounted to a printed circuit board (PCB) typically includes an insulating housing, a plurality of terminals mounted to the insulating housing, and a shell coupled with the insulating housing. The insulating housing has a mounting surface having a plurality of terminal grooves arranged side by side and a soldering surface opposite to the mounting surface and facing the PCB. The terminals are laterally received in the terminal grooves and have soldering portions extending towards the soldering surface for being soldered on the PCB. However, since the lateral arrangement of the terminals requires a large space, the electrical connector has to leave a sufficient horizontal area for receiving the terminals. Thus the horizontal area of the electrical connector will occupy extra space of the PCB, which affects the layout of other components on the PCB.

SUMMARY OF THE INVENTION

Accordingly, an object of the present invention is to provide an electrical connector mounted on a printed circuit board with a small occupied space. The electrical connector adapted for electrically connecting with a butting component includes an insulating housing and a plurality of terminals received in the insulating housing. The insulating housing defines a soldering surface and a mating surface contiguous to the soldering surface. The mating surface has a receiving recess for receiving the butting component. The receiving recess has a bottom protruding outwards to form a receiving plate substantially perpendicular to the soldering surface, with a plurality of terminal grooves extending substantially perpendicular to the mating surface formed thereon. Each of the terminals has a contacting portion received in the terminal groove and a soldering portion substantially perpendicular to the contacting portion. The soldering portions are arranged in plural rows and extend outside the soldering surface for being soldered on the PCB.

As described above, the receiving plate with the terminal grooves formed thereon is perpendicular to the soldering surface. The contacting portions of the terminals are mounted in the terminal grooves and the soldering portions are arrayed in plural rows, which can reduce the occupied area of the electrical connector mounted to the PCB. Accordingly, the available area of the PCB increases, which is in favor of more reasonable layout of other components of the PCB.

BRIEF DESCRIPTION OF THE DRAWINGS

The present invention will be apparent to those skilled in the art by reading the following description, with reference to the attached drawings, in which.

DETAILED DESCRIPTION OF THE EMBODIMENT

Figure 1:
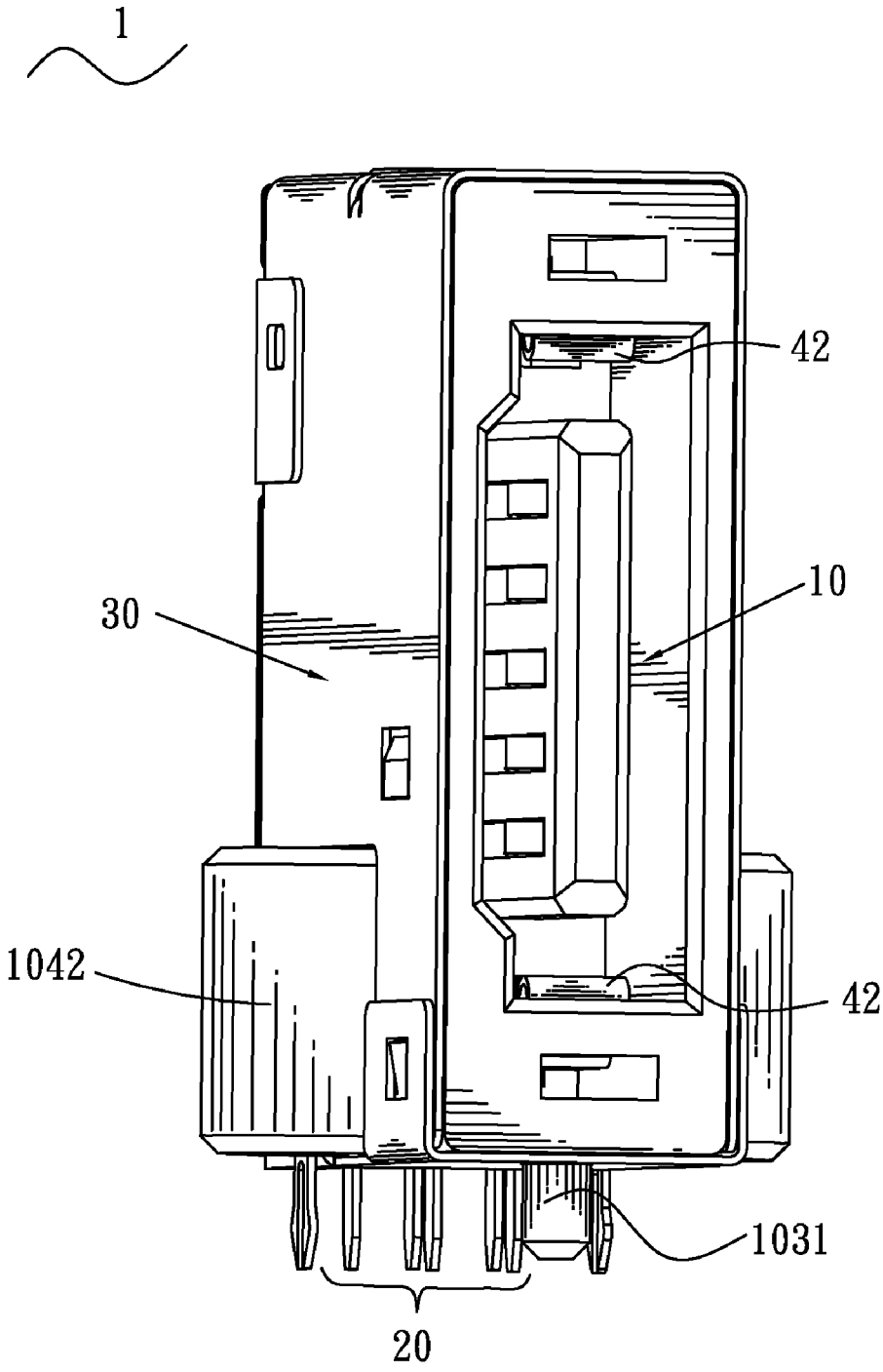
FIG. 1 is an assembled, perspective view of an electrical connector of an embodiment according to the present invention.

With reference to FIGS. 1-4, the embodiment of the invention is designed as an electrical connector 1. The electrical connector 1 adapted to mount to a printed circuit board (PCB, not shown) includes an insulating housing 10, a plurality of terminals 20 mounted to the insulating housing 10, and a shell 30 coupled with the insulating housing 10. The insulating housing 10 is substantially a rectangular shape and defines a mating surface 101, a rear surface 102 opposite to the mating surface 101, a pair of opposite lateral surfaces 104, and a soldering surface 103 contiguous to the mating surface 101, the rear surface 102 and the lateral surfaces 104. Herein, an inserting direction of a butting component (not shown) is defined as a front direction for clear description. The mating surface 101 has a receiving recess 11 of substantially oblong shape at a middle portion thereof, and two receiving holes 14 arranged at two ends thereof. The receiving recess 11 has a bottom protruded frontward to form a receiving plate 12. The receiving plate 12 is perpendicular to the soldering surface 103 and has a plurality of terminal grooves 13 extending frontward and rearwards and passing through the rear surface 102. The terminals 20 can be assembled to the insulating housing 10 from a rear direction. The receiving hole 14 communicates with the receiving recess 11 and extends rearwards to pass through the rear surface 102.

Figure 2:
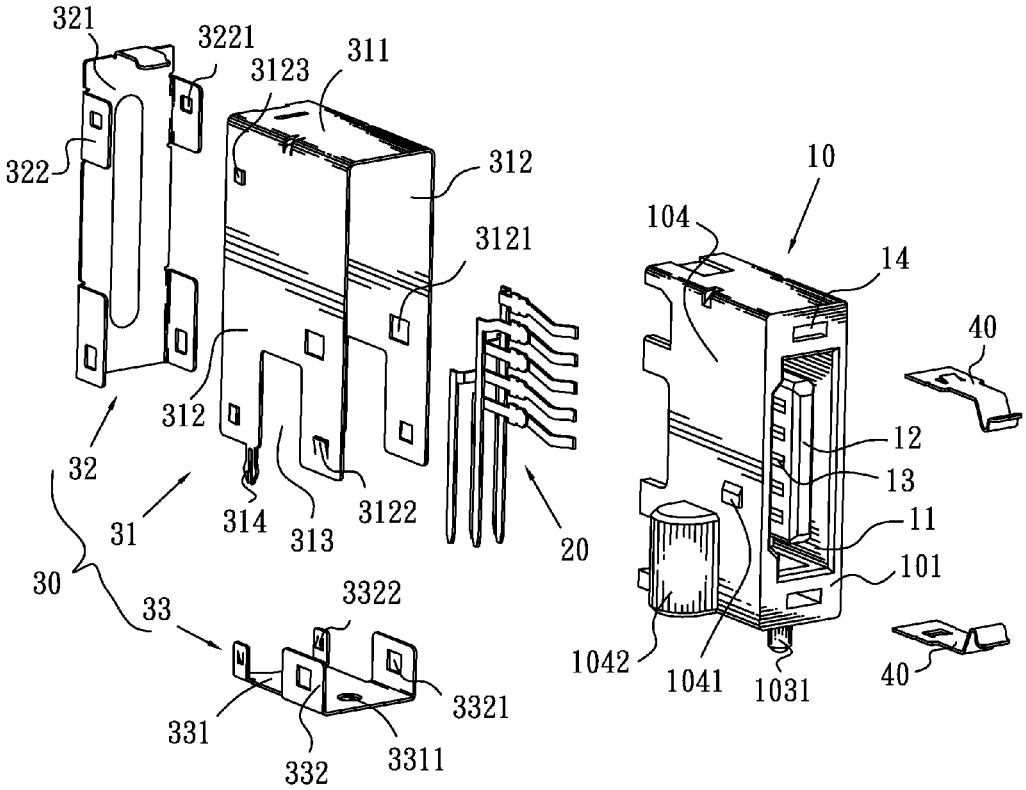
FIG. 2 is an exploded, perspective view of the electrical connector shown in FIG. 1.
Figure 3:
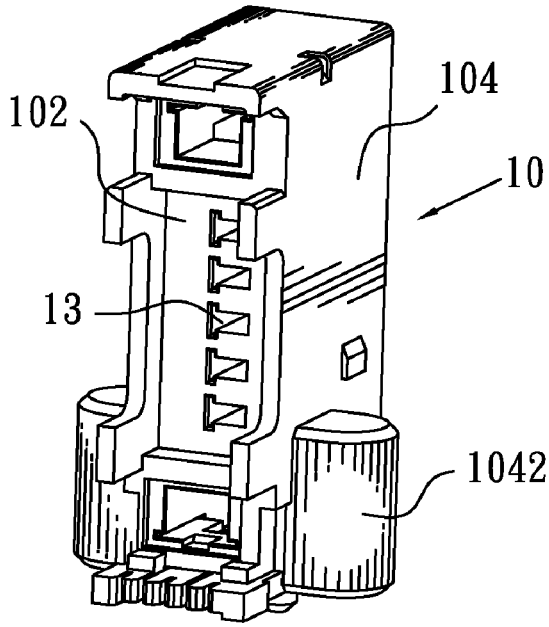
FIG. 3 is a perspective view of an insulating housing of the electrical connector shown in FIG. 2 viewed from a rear angle.
Figure 4:
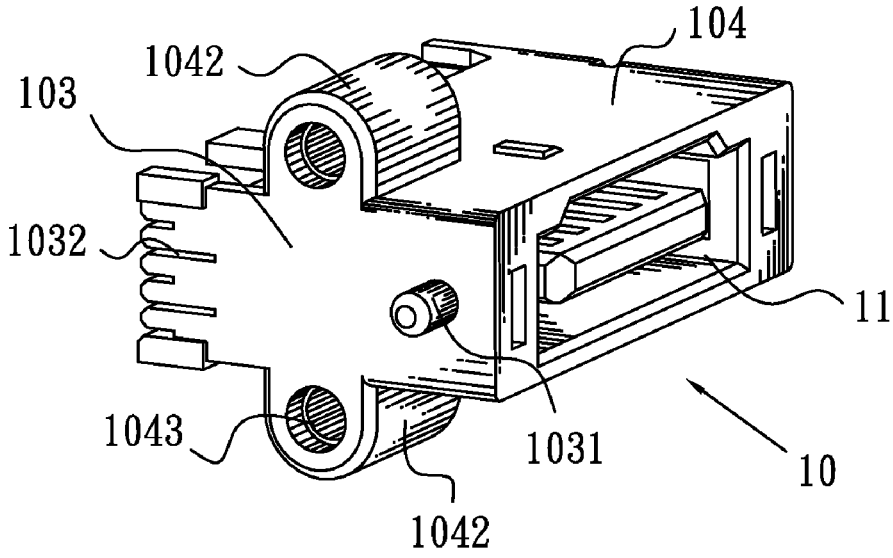
FIG. 4 is a perspective view of the insulating housing of the electrical connector shown in FIG. 2 viewed from a bottom angle.
Figure 5:
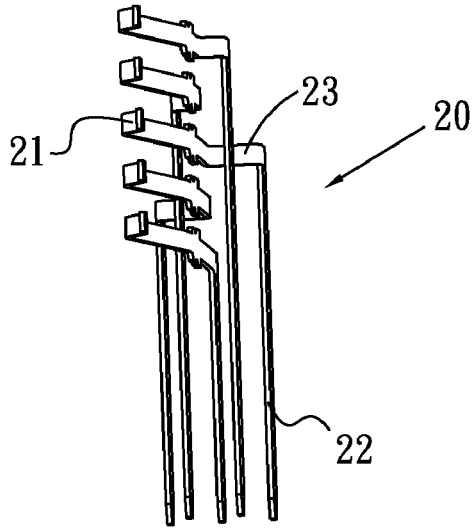
FIG. 5 is a perspective view of terminals of the electrical connector shown in FIG. 2 viewed from another angle.
Figure 6:
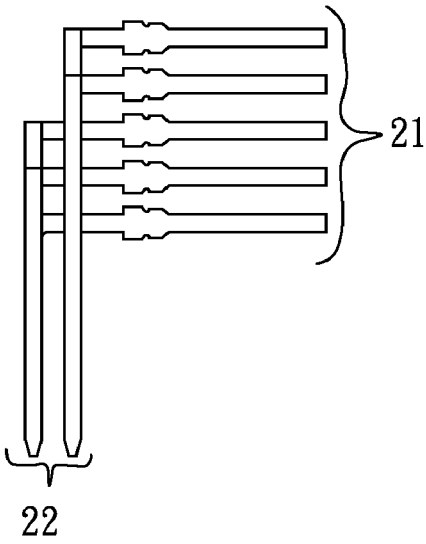
FIG. 6 is a plan view of the terminals shown in FIG. 5.
Figure 7:
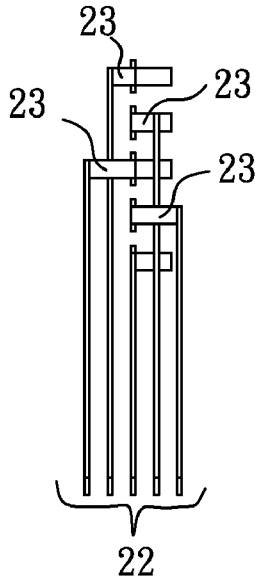
FIG. 7 is a perspective view of the terminals shown in FIG. 5 viewed from a rear angle.
Figure 8:
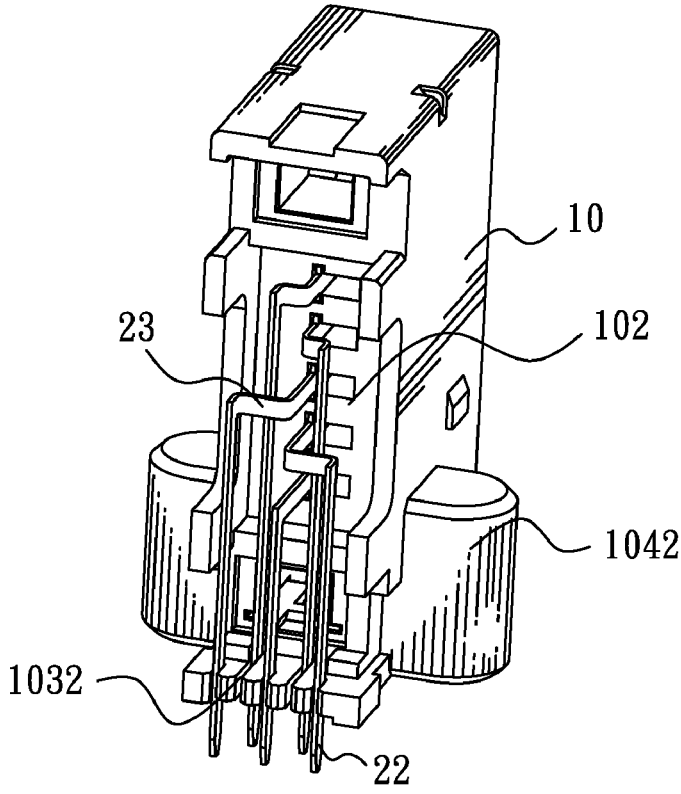
FIG. 8 is an assembled, perspective view showing a state that the terminals are mounted in the insulating housing of FIG. 2 viewed from a rear angle.

Referring to FIGS. 2-4, each of the lateral surfaces 104 has a buckling lump 1041 at a front thereof and an installing portion 1042. The installing portion 1042 is shaped to show a pillar of semi-circular shape, with a bottom surface thereof flush with the soldering surface 103. An installing hole 1043 is formed at the bottom surface of the installing portion 1042. The soldering surface 103 has a positioning portion 1031 at a front end thereof and a plurality of restraining slots 1032 at a rear end thereof exceeding the rear surface 102. In assembly, the positioning portion 1031 is inserted into a hole of the PCB for positioning the electrical connector 1. Two fastening elements, taking screws for example, are passed through fixing holes of the PCB and engaged with the installing holes 1043 for fixing the electrical connector 1 to the PCB.

Please refer to FIG. 2 in conjunction with FIGS. 5-8, each of the terminals 20 has a contacting portion 21 and a soldering portion 22 perpendicular to the contacting portion 21. In this embodiment, there are five terminals 20. The contacting portions 21 are arranged in a vertical row to be received in the corresponding terminal grooves 14. The soldering portions 22 are arranged in two rows to be restrained in the restraining slots 1032 for fixing the terminals 20. One of the soldering portions 22 in alignment with the receiving plate 12 is connected with an end of the contacting portion 21 to show an inverted-L shape. The other soldering portions 22 biased from the receiving plate 12 are connected with the contacting portions 21 by connecting portions 23. The connecting portion 23 extends perpendicular to the contacting portion 21 and the soldering portion 22 and connects with an end of the contacting portion 21 and an end of the soldering portions 22. In this embodiment, the lengths of the soldering portions 22 are different, and the connecting portions 23 disposed in the same row are same in length. It should be noted that the shape and the arrangement of the terminals can be changed for meeting different demands and should not be limited. The soldering portions of the terminals can be arranged in plural rows when the quantity of the terminals increases or the construction of the electrical connector is altered. Also, the soldering portions can have the same length when the connecting portions extend slantingly so that the contacting portions are arranged in a vertical row.

Referring to FIGS. 1-2, the shell 30 coupled with the insulating housing 10 has a first shell 31, a second shell 32 and a third shell 33. The first shell 31 defines a first covering plate 311 and a pair of lateral plates 312 extending downwards from two opposite sides of the covering plate 311 and flanked to the lateral surfaces 104. Each of the lateral plates 312 has an indentation 313 at a lower portion thereof for accommodating the installing portion 1042. An inserting tab 314 is extended downwards from a rear end of a bottom edge of the lateral plate 312 and inserted into an assembling hole of the PCB for positioning the electrical connector 1 to the PCB. A front of the lateral plate 312 has a buckling hole 3121 at a substantially middle portion thereof corresponding to the buckling lump 1041 and a buckling piece 3122 at a bottom thereof. A rear of the lateral plate 312 is also formed two buckling pieces 3123 at two ends thereof. The second shell 32 has a second covering plate 321 and a plurality of fixing slices 322 extending perpendicularly from two sides of the second covering plate 321. Each of the fixing slices 322 has a buckling hole 3221 mating with the buckling piece 3123 for connecting the first shell 31 and the second shell 32. The third shell 33 has a third covering plate 331 attached to the soldering surface 103 when mounted to the insulating housing 10 and a plurality of buckling slices 332 extending perpendicularly from two opposite sides of the third covering plate 331. The third covering plate 331 has a through hole 3311 adapted for allowing the positioning portion 1031 to pass therethrough. The buckling slices 332 adjacent to the through hole 3311 have buckling holes 3321 corresponding to the buckling pieces 3122. The buckling slices 332 away from the through hole 3311 are machined to form buckling pieces 3322 coupled with the buckling holes 3221. In assembly, the first shell 31 is coupled to the insulating housing 10 from a top direction. The second shell 32 is covered to the insulating housing 10 from a rear direction and connected with the first shell 31. The third shell 33 is assembled to the insulating housing 10 from a bottom direction and fastened to the first shell 31 and the second shell 32. It should be noted that the assembling method of the electrical connector can be changed and should not be limited.

Figure 9:
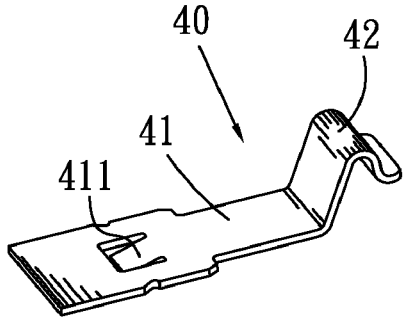
FIG. 9 is a perspective view of an elastic element of the electrical connector shown in FIG. 2.

With reference to FIG. 1 and FIG. 9, the electrical connector 1 further has two elastic elements 40 received in the receiving holes 14. The elastic element 40 has a main body 41 of flat-board shape, with a fixing piece 411 formed thereon. An end of the main body 41 is extended upwards and curved downwards to form an elastic end 42 of substantially inverted-V shape. The main body 41 is fixed in the receiving hole 14 with the fixing piece 411 against the insulating housing 10. The elastic end 42 is positioned into the receiving recess 11 and rests against the inserted butting component.

As described above, the receiving plate 12 with the terminal grooves 13 formed thereon is perpendicular to the soldering surface 103. The contacting portions 21 of the terminals 20 are mounted to the terminal grooves 13, and the soldering portions 22 are arrayed in two rows, which can reduce the occupied area of the electrical connector 1 mounted to the PCB. Accordingly, the available area of the PCB increases, which is in favor of more reasonable layout of other components of the PCB.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An electrical connector adapted to be mounted to a PCB for electrically connecting with a butting component, comprising:

an insulating housing defining a soldering surface and a mating surface contiguous to the soldering surface, the mating surface having a receiving recess for receiving the butting component, the receiving recess having a bottom protruding outwards to form a receiving plate substantially perpendicular to the soldering surface, with a plurality of terminal grooves extending substantially perpendicular to the mating surface formed thereon; and a plurality of terminals received in the insulating housing, each of the terminals having a contacting portion received in the terminal groove and a soldering portion substantially perpendicular to the contacting portion, the soldering portions arranged in plural rows and extending outside the soldering surface for being soldered on the PCB.

2. The electrical connector as claimed in claim 1, wherein the insulating housing defines a rear surface opposite to the mating surface, the terminal grooves pass through the rear surface, the terminals are mounted to the insulating housing from the rear surface.

3. The electrical connector as claimed in claim 2, wherein the soldering surface has a rear end outside the rear surface and formed a plurality of restraining slots thereon, the soldering portions pass through the restraining slots and exceed the soldering surface.

4. The electrical connector as claimed in claim 1, wherein at least one of the soldering portions is connected with the corresponding contacting portion by a connecting portion perpendicular to the contacting portion and the soldering portion to make the at least one of the soldering portions biased from the receiving plate.

5. The electrical connector as claimed in claim 4, wherein another of the soldering portions is connected with the corresponding contacting portion to show an inverted-L shape to make the soldering portion disposed substantially in alignment with the receiving plate.

6. The electrical connector as claimed in claim 1, wherein the soldering surface is protruded outwards to form a positioning portion adjacent to the mating surface and inserted into the PCB for positioning the electrical connector.

7. The electrical connector as claimed in claim 6, further comprising a shell coupled with the insulating housing, the shell having a covering plate for being attached to the soldering surface, the covering plate defining a through hole for allowing the positioning portion to pass therethrough.

8. The electrical connector as claimed in claim 7, wherein the shell has two lateral plates flanked to the insulating housing, each of the lateral plates has an inserting tab exceeding the soldering surface and inserted into the PCB for positioning the electrical connector.

9. The electrical connector as claimed in claim 1, wherein the insulating housing defines two opposite lateral surfaces adjacent to the mating surface and the soldering surface, the lateral surfaces are protruded outwards to form an installing portion, a bottom of the installing portion is flush with the soldering surface and has an installing hole for fixing the electrical connector to the PCB.

* * * * *